United States Patent [19]

Lee et al.

[11] 4,151,996

[45] May 1, 1979

[54] AIR GUN SHOT ARRESTING ASSEMBLAGE

[76] Inventors: Robert W. Lee; Beverly G. Lee, both of 3895 W. 2nd Ave., Hialeah, Fla. 33012

[21] Appl. No.: 764,369

[22] Filed: Jan. 31, 1977

[51] Int. Cl.[2] ..... F41J 1/10; F41J 1/14

[52] U.S. Cl. ..... 273/102.4; 273/102 S; 206/315 R; 206/394

[58] Field of Search ..... 273/102.4, 102 B, 102.5, 273/102 R; 73/167; 272/103

[56] References Cited

U.S. PATENT DOCUMENTS

| | | | |
|---|---|---|---|
| 201,328 | 3/1878 | Chamberlin | 273/103 |
| 890,228 | 6/1908 | Houck | 273/102.4 |
| 1,525,339 | 2/1925 | Toohey | 273/102 B |
| 1,568,013 | 12/1925 | Warfield | 273/102 S |
| 2,294,730 | 9/1942 | Eggers | 273/102 B |
| 2,691,526 | 10/1954 | Wesley et al. | 273/102.4 |
| 2,753,829 | 7/1956 | Agra | 273/55 A |
| 2,818,258 | 12/1957 | Stern | 273/102 B |
| 3,294,400 | 3/1966 | Goldstein | 273/1 E |
| 3,334,902 | 8/1967 | Schwankert | 273/102.4 |
| 3,845,957 | 11/1974 | Lohr et al. | 273/102 R |

FOREIGN PATENT DOCUMENTS

| | | | |
|---|---|---|---|
| 173918 | 12/1934 | Switzerland | 273/102 R |
| 11604 of | 1911 | United Kingdom | 273/102 B |
| 213002 | 3/1924 | United Kingdom | 273/102 B |
| 350250 | 6/1931 | United Kingdom | 273/102 B |

*Primary Examiner*—Richard C. Pinkham
*Assistant Examiner*—Lawrence E. Anderson

[57] ABSTRACT

A bullet trap for safely arresting steel BB ammunition shot from an air gun. Its projectile energy absorbing and rebound control components are the novel combination of a roll of paper towels enclosed in a plastic bag. The surfaces of the towels and bag are held in a spaced apart relationship by an open framework spacer. The supple opposition offered by the easily penetrated roll of paper towels effectively absorbs the projectiles energy, and impedes its further flight. The BBs will usually imbed themselves in the roll of towels, but any occasional BB that bounces away from that surface will be arrested by the surface of the plastic bag. The spaced apart relationship of these surfaces provides a vertical passageway for the spent projectile to drop to the bottom of the bag, where it will be retained.

16 Claims, 5 Drawing Figures

AIR GUN SHOT ARRESTING ASSEMBLAGE

This invention relates in general to bullet trapping assemblages, and more specifically to such assemblages that may be used with an air gun firing steel BB ammunition within the limited confines of the average home.

For the average gun enthusiast, it is increasingly difficult to find an appropriate location or suitable conditions to use conventional firearms without traveling lengthy distances away from home. Consequently, with each passing year there is more interest shown in air guns. This is especially true of the higher velocity, more accurate, air guns. Modern technology has given us vastly improved air guns in recent years, but the necessary improvements in their projectile control have not, unfortunately, kept pace with that development. Before the present invention, it was virtually impossible to use a powerful air gun and BB ammunition in the limited confines of an average house because of the problem of projectile ricochette. Since the steel BB does not flatten or distort upon impact with a hard object such as a conventional metal bullet trap, very little of the BB's kinetic energy is absorbed by its impact with such a trap. Consequently, a dangerous bounce or ricochette becomes a likely possibility, with the consequent danger to both personal and property damage. Consequently, all too soon after the purchase of a modern air gun, the initial enthusiasm of the average shooter ebbs, and an enjoyable hobby soon suffers neglect. There is a definite need for an inexpensive yet safe projectile trap for inside use of both BBs and pellets.

It is, therefore, a primary object of this invention to provide a shot arresting assemblage that makes indoor air gun shooting in the home both pleasurable and practical.

Another important object is to provide a shot arresting assemblage that assures complete safety from ricochetting air gun projectiles by safely capturing and retaining the projectiles.

Still another object is to provide an assemblage whose energy absorbing and rebound control expendable components are not only inexpensively, conveniently, and easily obtained, but also long lasting.

Still another objective is to provide a non-metallic assemblage that assures a low noise level in the target area.

A further object is to provide a lightweight and compact assemblage for ease in portability and storage.

A major feature of the herein described bullet trap or projectile arresting assemblage is the novel combination of articles that comprise its projectile energy absorbing and rebound control components. The energy absorbing component consists of a quantity of easily penetrated, but supple and resilient roll of projectile energy absorbing material such as a roll of toilet tissue or, preferably, a roll of paper towels. The paper product is enclosed in a projectile penetrable bag, such as a plastic bag used for food storage or waste disposal. These articles may be inexpensively purchased and conviently obtained.

A projectile, after being shot from an airgun, first passes through a penetrable target which is suspended near the front or mouth of the assemblage. As it continues its flight, the projectile penetrates the frontal surface of the plastic bag, transits an open space between the front surfaces of the bag and towels, and strikes the roll of paper towels which is inside the bag. The supple opposition offered by the easily penetrated roll of paper towels effectively absorbs the energy of the projectile, and impedes its further flight. The projectile will usually imbed itself in the tightly packed and relatively soft paper towels, but any occasional one that mildly bounces away will be apprehended by the inner surface of the plastic bag, and will fall through a vertical passageway, or open space, between the frontal surfaces of the towels and bag. This passageway, is provided by a spacer, which is detachably fastened to the roll of towels before the towels and the spacer are inserted into the bag. This attachment may be accomplished by utilizing a resilient retaining connection such as rubber bands, springs, or other suitable means. The open framework of the spacer allows the unobstructed passage of the projectile before the projectile strikes the roll of paper towels. The rear of the spacer is held against the roll of towels, and the front of the spacer projects forwardly away from the roll, or towards the marksman, so that it holds the front surfaces of the bag and towels in a spaced apart relationship to each other. This open space is the vertical passageway which allows the spent projectile to fall to the bottom of the bag.

A preferred embodiment of the invention is shown in the attached drawings.

Figure 1:
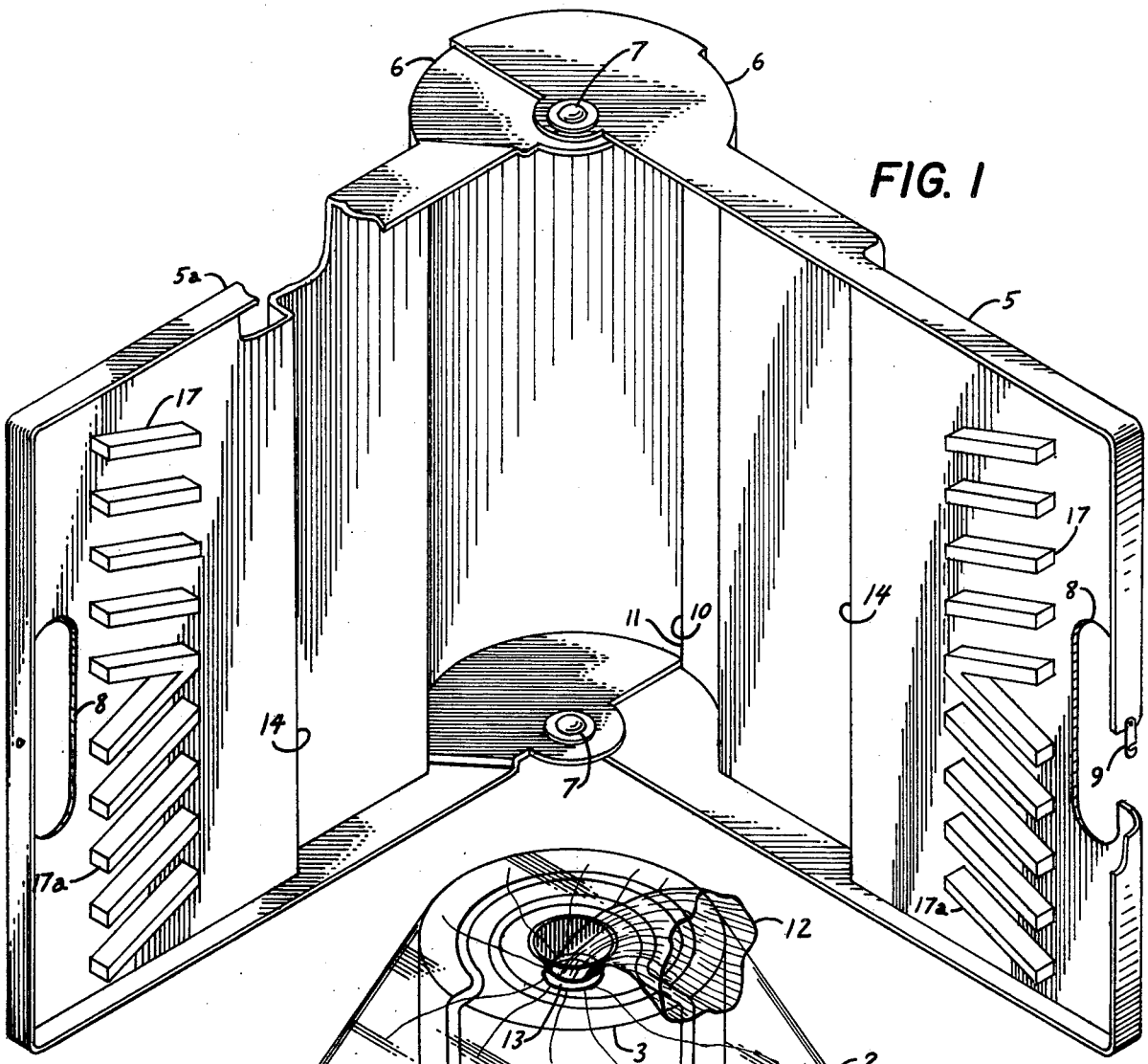
FIG. 1 is a front perspective view of the casing of the projectile trap in opened position and before the insertion of the projectile control components.

The casing in the preferred embodiment of the present invention is in the form of a two-sided case, and is constructed from a high impact plastic as defined by the Plastics Standards Falling Dart Impact Tests. In use, the casing is carried by the handles 8 to a safe shooting location and placed on an appropriate surface. The securing latch 9 is unfastened, and the handles 8 are spread apart opening the sides 5 and 5*a* of the case in a book-like fashion, best seen in FIG. 1, with the open end facing towards the marksman. Each side of the case is basically a "mirror image" of the other side, with the exceptions of a shoulder 10 being formed in the side 5, and the fact that side 5*a* is designed to slide inside of side 5, and being pivotly mounted therein by rivets 7 or other suitable means. While opening, the sides 5 and 5*a* swing apart until the shoulder 10 of side 5 stops the travel of point 11 of side 5*a*. The sides 5 and 5*a* of the case, when opened for use, act as projectile deflecting structural members which channel a "wide shot" into the longitudinal central area of the assemblages' projectile trapping components. This area of the roll is the thickest part of the roll, and consequently offers the most resistance to the passage of a projectile. The sides 5 and 5*a* are also fabricated from a high impact plastic. The rearward extremity of each side of the case terminates in forming a semi-circular curve 6 which, when mounted to its' counterpart by rivets 7, forms a cylindrical chamber into which the projectile control components will be retained.

Figure 2:
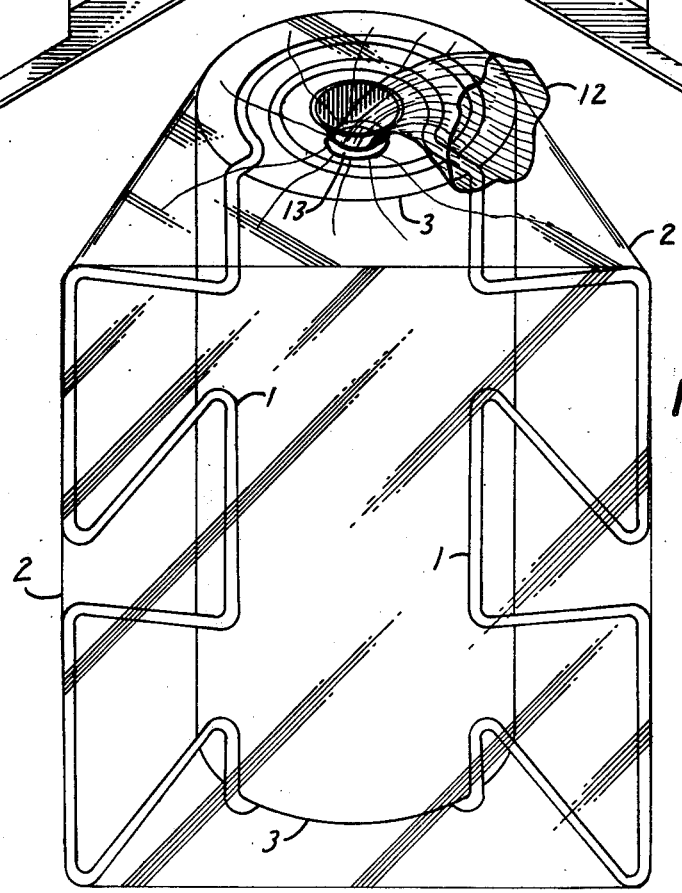
FIG. 2 is a front perspective view of the projectile control components, consisting of a plastic bag, roll of paper towels, and a spacer, before their insertion into the cylindrical chamber of the casing.
Figure 3:
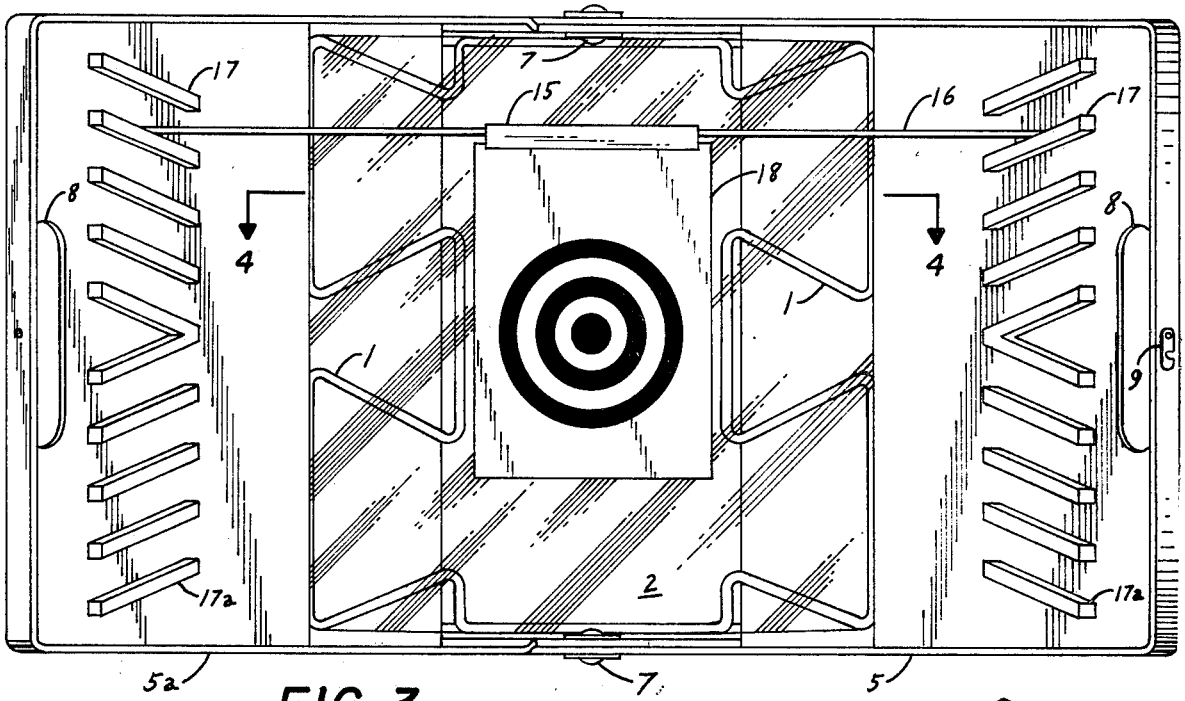
FIG. 3 is a front elevation view of the opened casing, its enclosed projectile control components, and a penetrable target.
Figure 4:
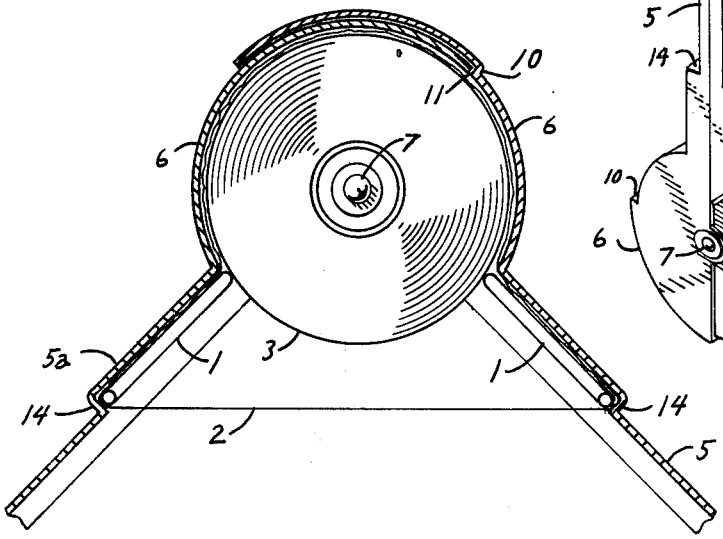
FIG. 4 is a partial cross sectional view of FIG. 3, along lines 4—4.
Figure 5:
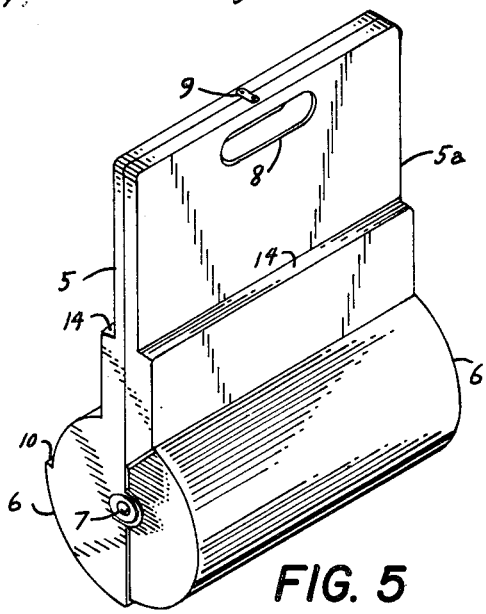
FIG. 5 shows the casing when closed and secured for storage or transporting.

The projectile energy absorbing and rebound control components, before their insertion into the opened case, are best shown in FIG. 2. The original paper wrapper should be left on the roll of paper towels. This prevents the roll from unwinding after it has been placed inside the plastic bag. However, a string or tape around the outside of the roll will accomplish the same purpose.

The preferred embodiment of the spacer 1 is formed from a spring wire. Its' coiled ends secure the spacer to the roll of paper towels 3. The upper, middle, and lower vertical sections of the spacer 1 are held against the roll of towels 3. The intermediate vertical sections are held away from the roll of towels, thereby being able to hold the frontal surface of the bag 2 and the frontal surface of the enclosed roll of paper towels 3 in a spaced apart relationship. This open space provides a vertical passageway for the spent projectile as it falls to the bottom of the bag. The open framework of the spacer 1 allows the unobstructed passage of a projectile therethrough. The roll of paper towels 3 and the attached spacer 1 are inserted through the open end 12 of the bag 2, and the closure of the bag is accomplished with a rubber band 13 or other suitable means. These components are then inserted into the cylindrical chamber formed by the curved ends 6 of the sides 5 and 5*a*. The vertical forward portions of the spacer 1 rest against the shoulder 14 formed in the sides 5 and 5*a* of the case. The outward spring tension of the spacer 1 holds the sides 5 and 5*a* in their spread apart relationship to each other.

A penetrable target 18 is inserted in a target clamp 15 which hangs from a support rod 16. The target 18 is centered and suspended along the line of intended projectile trajectory, which is along the longitudinal front center line of the roll of paper towels 3. The preferred embodiment of the present invention also has a means of varying the heighth of the penetrable target 18. Holding elements for the target support rod 16 may consist of slots or, preferably, projections 17. These elements are arranged in matching vertical rows and are oriented in a slanting downward and rearward direction in the upper half of the sides 5 and 5*a* of the casing. The forward edges of the projections 17 are higher than the rearward edges. The ends of the target support rod 16 are placed in the slots, not shown, or on top of the projections 17. The target support rod 16 is moved rearward and downward until the ends of the rod 16 are halted by the converging sides 5 and 5*a* of the casing. The rod 16, clamp 15, and target 18 are then retained in place there by gravity. Since the matched pairs of projections 17 are located at various vertical heights, the heighth of the target 18 may be altered--governed by which set of projections 17 the rod 16 is placed on. After numerous projectiles have penetrated the target 18 and have been ingested by the surface of the roll of paper towels behind the target, the vertical position of the target 18 is changed by raising or lowering the support rod 16 to a different set of projections 17. Consequently, the upper, middle, and lower frontal surfaces of both the bag 2 and the roll of paper towels 3 can be utilized for projectile arresting. After the total front surface of the roll of paper towels 3 has been mutilated by the projectiles, the roll 3 and bag 2 are turned so that their unused surface is presented to the line of fire behind the target 18. This roll and bag turning procedure in conjunction with the vertical target adjustment can be repeated until the total outside surfaces of both the roll and bag have been mutilated by the impinging projectiles. Consequently, many hundreds of projectiles can be safely arrested by a single set of easily, conveniently, and inexpensively obtained roll of paper towels and plastic bag. The projections 17*a* on the lower half of the sides 5 and 5*a* of the case are oriented in the opposite direction of the projections 17 in the upper half of the sides. Consequently, no matter which end of the cylindrical chamber the projectile trap is standing on, the top half of the sides 5 and 5*a* contain target support rod holding elements that are oriented in a downward and rearward direction.

The present invention was basically designed to be used with richochette-prone steel BB projectiles. However, the assemblage may also be used with lead pellet type ammunition. The lead pellets' characteristic of expanding and distorting upon contact with any solid object, thereby creating larger individual entry holes, will naturally destruct the roll of paper towels faster.

After the shooting session, the bag 2, roll 3, and spacer 1 are left in position in the circular chamber of the case, the sides 5 and 5*a* of the case are closed together, and the latch 9 is secured. The assemblage then defines a very compact case that is both easily carried and stored.

Since modifications and changes may occur to those skilled in the art, it is not desired to limit the invention to the exact configurations and operations herein shown and described. Other suitable modifications or embodiments may be achieved, falling within the scope of the invention as stated in the appended claims.

Having shown and described the present invention, what I claim is:

1. A projectile arresting assemblage, comprising a projectile rebound control receptacle, a roll of penetrable energy absorbing paper, and a projectile deflecting member; wherein said deflecting member at least partially surrounds said roll and extends radially therefrom such that any projectile striking the face of said member is deflected towards, and enters, the longitudinal central area of said roll in a direction that is substantially perpendicular to the axis of said roll, whereby the supple opposition offered by said roll of paper substantially eliminates the kinetic energy of the projectile and impedes its forward flight, and said rebound receptacle is spaced along at least an arcuate region from one end of said roll to the other such that any projectile, rebounding from said roll, falls to the bottom of said receptacle where said projectile is arrested and retained.

2. The assemblage of claim 1 and wherein the faces of a plurality of said deflecting members may be adjusted and maintained in both a spaced apart and a substantially abutting relationship to each other, whereby the said faces of said members both deflect an impinging projectile into the longitudinal central area of said roll of paper, and fold together in close proximity to each other for compact storage of said assemblage.

3. The projectile arresting assemblage of claim 1 and wherein said deflecting member is fabricated from a high impact plastic as defined by Plastics Standards Falling Dart Impact Tests.

4. The assemblage of claim 1, and further comprising a target support rod adapted to support a target, a pair of said projectile deflecting members disposed in a convergingly oriented relation towards the longitudinal central area of said roll of paper, and said projectile deflecting members each further comprising a plurality of target support holding elements, said holding elements being disposed at varying heights on each of said projectile deflecting members, and said holding elements adapted to both sustain said target support rod and provide a selective heighth adjustment capability for both the said target support rod and the target.

5. The assemblage of claim 4, and wherein a first plurality of said target support holding elements is orientated, relative to the line of projectile travel, in a rearward and downward direction, with the rear of said holding elements being lower than the front of said holding elements when said assemblage is sitting in a first position, and whereby said elements both sustain said support rod and allow said support rod to be moved rearward and downward until the ends of said rod contact the said convergingly oriented projectile deflecting members, thus gravitationally and frictionally securing said target support rod to said projectile deflecting members.

6. The projectile arresting assemblage of claim 5 and wherein said projectile deflecting members contain a second plurality of holding elements orientated so that when said assemblage is inverted to a second position, said second plurality of holding elements is orientated substantially the same as a first plurality of holding elements were in the first position.

7. A projectile arresting assemblage comprising a penetrable roll of paper enclosed within a bags, a projectile deflecting member at least partially surrounding said roll and extending substantially radially therefrom, wherein said deflecting member is adapted and positioned so that an impinging projectile on the face of said member is deflected into said bag and into the longitudinal central area of said enclosed roll in a direction that is substantially perpendicular to the axis of said roll of paper, and whereby the supple opposition offered by said penetrable roll substantially eliminates the kinetic energy of said projectile and impedes its forward flight, whereby the disunion of the surfaces of said enclosed roll and said bag along at least one arcuate region from one edge of the roll to the other provides a vertical passageway between said surfaces whereby a projectile, after rebounding from said roll, falls to the bottom of said bag where said projectile will be arrested and retained.

8. The assemblage of claim 7, and further comprising an open framework spacer that allows the unobstructed forward passage of said projectile therethrough, said framework spacer being detachably affixed to said roll with a portion of said framework spacer projecting forwardly and away from said roll, thereby separating the surfaces of said bag and said enclosed roll and holding said surfaces in a spaced apart relationship to each other, thus providing a vertical passageway between the surfaces of said roll and said bag, said passageway allowing any projectile that rebounds from said roll to fall to the bottom of said bag, where said projectile will be arrested and retained.

9. The assemblage of claim 7, and wherein said paper is a roll of paper towels.

10. The assemblage of claim 7, and wherein said paper is a roll of toilet tissue.

11. The assemblage of claim 7, and wherein said bag is fabricated from a plastic material.

12. The assemblage of claim 7, and wherein said assemblage further comprises, in combination, a roll securing means that retains said roll in such a position that a projectile enters said roll in a direction that is substantially perpendicular to the axis of said roll, and a spacing means that holds the surfaces of said roll and said bag in a spaced apart relationship to each other, thus providing a vertical passageway between the surfaces of the roll and bag that allows any said projectile that rebounds from said roll to fall to the bottom of said bag where said projectile will be arrested and retained.

13. The assemblage of claim 12, and wherein said roll securing means further comprises a chamber that supports and orients said roll in such a position that said impinging projectile enters said roll in a direction that is perpendicular to the axis of said roll.

14. The assemblage of claim 12, and wherein said spacing means further comprises an open framework spacer that allows the unobstructed forward passage of said projectile therethrough, said framework spacer is detachably affixed to said roll, and a portion of said framework projects forwardly and away from said roll, thereby holding the surfaces of said bag and said enclosed roll in a spaced apart relationship to each other, thus providing a vertical passageway between the surfaces of said roll and said bag, said passageway allowing any projectile that rebounds from said roll to fall to the bottom of said bag, where said projectile will be arrested and retained.

15. The assemblage of claim 14, and wherein said assemblage further comprises a securing device for said open framework spacer, said device being a detachable and resilient retaining connector by which the said open framework spacer is temporarily secured to said roll of paper.

16. A projectile arresting assemblage comprising a roll of paper towels and at least one projectile deflecting member having a vertically adjustable target support; said deflecting member being adapted and oriented to deflect an impinging projectile off its' face into said roll of paper towels; said roll being adapted and maintained in such a position that said impinging projectile enters said roll in a direction that is substantially perpendicular to the axis of said roll; and open framework spacer that allows the passage of a projectile therethrough, said spacer adapted to be placed on and secured to said roll of paper towels; a plastic bag that envelopes both the said roll of paper towels and said open framework spacer, whereby the supple opposition of the roll of paper towels substantially eliminates the kinetic energy of an impinging projectile and impedes its' forward flight, and said plastic bag arrests any projectile that rebounds away from the surface of said roll of paper towels, and said open framework spacer separates the frontal surfaces of said roll of paper towels and said plastic bag, thus providing a vertical passageway between the surfaces of the roll and the bag that allows a rebounding projectile to fall to the bottom of said plastic bag, where said projectile will be arrested and retained.

* * * * *